US008430464B2

(12) United States Patent
Togawa

(10) Patent No.: US 8,430,464 B2
(45) Date of Patent: Apr. 30, 2013

(54) LIQUID EJECTING APPARATUS

(75) Inventor: Yuki Togawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 663 days.

(21) Appl. No.: 12/620,663

(22) Filed: Nov. 18, 2009

(65) Prior Publication Data

US 2010/0128073 A1 May 27, 2010

(30) Foreign Application Priority Data

Nov. 27, 2008 (JP) ..... 2008-303091

(51) Int. Cl.
*B41J 25/308* (2006.01)
*B41J 2/165* (2006.01)

(52) U.S. Cl.
USPC ..... 347/8; 347/5; 347/20; 347/22; 347/34

(58) Field of Classification Search ..... 347/8, 34
See application file for complete search history.

(56) References Cited

U.S. PATENT DOCUMENTS

| | | | | |
|---|---|---|---|---|
| 6,220,693 | B1 * | 4/2001 | Bode et al. | 347/34 |
| 6,719,398 | B1 * | 4/2004 | McElfresh et al. | 347/21 |
| 7,604,332 | B2 * | 10/2009 | Nagashima | 347/84 |
| 8,075,120 | B2 * | 12/2011 | Ide et al. | 347/92 |

FOREIGN PATENT DOCUMENTS

| | | | |
|---|---|---|---|
| JP | 2005-212323 | | 8/2005 |
| JP | 2006-231740 A | * | 9/2006 |
| JP | 2008-302577 | | 12/2008 |

OTHER PUBLICATIONS

Machine translation of JP2006-231740A (Sep. 2006).*

* cited by examiner

*Primary Examiner* — Ryan Lepisto
(74) *Attorney, Agent, or Firm* — Workman Nydegger

(57) ABSTRACT

A liquid ejecting apparatus includes a liquid ejecting head which ejects liquid from a nozzle orifice, a blowing mechanism disposed on the liquid ejecting head side, and a gap control unit which relatively controls a gap between the nozzle orifices and an ejection target medium, in which driving of the blowing mechanism is controlled depending on the gap between the nozzle orifices and the ejection target medium.

6 Claims, 5 Drawing Sheets

LIQUID EJECTING APPARATUS

BACKGROUND

1. Technical Field

The present invention relates to a liquid ejecting apparatus which discharges liquid from nozzle orifices of a liquid ejecting head such as an ink jet recording head.

2. Related Art

There are several types of liquid ejecting heads which discharge (or eject) liquid droplets from nozzle orifices by causing liquid pressure to change in a pressure chamber. Examples of such liquid ejecting heads include an ink jet recording head (hereinafter, simply referred to as recording head) used in an image recording device such as an ink jet recording device (hereinafter, simply referred to as printer), a color material ejecting head used to manufacture a color filter of a liquid crystal display, an electrode material ejecting head used to form an electrode of an organic electro luminescence (EL) display or a field emission display (FED), and a bioorganic substance ejecting head used to manufacture a biochip (biochemical element).

In the recording head, for example, in the case in which the liquid is discharged from the nozzle orifices, fine liquid droplets called satellite droplets are produced along with main liquid droplets, and sometimes the satellite droplets cannot arrive on an absorbing member and turn into mist. The liquid droplets, which turned into mist, (hereinafter, referred to as mist of liquid droplets) cause problems such that they pollute the inside of the device by scattering in the air while they are flying and cause a failure such as an electrical short-circuit by sticking to an electronic part such as a circuit board.

On the other hand, in the device in which a heater is disposed under a platen, on which a recording medium (discharge target) is placed, to dry the liquid droplets landing on a recording medium, the liquid droplets heated by the heater volatilize and substances in the liquid droplets rise upward and stick to the liquid ejecting head. As a result, there is a possibility that an adhesive used in the liquid ejecting head is likely to deteriorate. For such a reason, JP-A-2005-212323 suggests a technique of blowing the mist of the liquid droplets or the substances of the volatilizing liquid droplets away by blowing a stream of air to a space between the liquid discharging surface of the liquid ejecting head and the recording medium by a blowing machine.

However, in the technique, if the stream of air is blown from the blowing machine in the case in which a platen gap (gap between the nozzle orifices and the recording medium) is large, the mist of the liquid droplets is easily scattered in the device, which causes failures of the blowing machine and errors in the landing position of the discharged liquid droplets.

SUMMARY

An advantage of some aspects of the invention is that it provides a liquid ejecting apparatus capable of controlling failures caused by discharged liquid droplets while maintaining the discharge stability of the liquid droplets.

According to one aspect of the invention, there is provided a liquid ejecting apparatus including a liquid ejecting head which ejects liquid from a nozzle orifice, a blowing mechanism disposed on the liquid ejecting head side, and a gap control unit which relatively controls a gap between the nozzle orifices and an ejection target medium, in which the driving of the blowing mechanism is controlled depending on the gap between the nozzle orifices and the ejection target medium.

According to the structure, the liquid ejecting apparatus includes a liquid ejecting head which ejects liquid from a nozzle orifice, a blowing mechanism disposed on the liquid ejecting head side, and a gap control unit which relatively controls a gap between the nozzle orifices and an ejection target medium, in which the driving of the blowing mechanism is controlled depending on the gap between the nozzle orifices and the ejection medium. Accordingly, when the gap between the nozzle orifices and the ejection target medium is narrow, the blowing mechanism is driven to blow a stream of air, which can suppress the air volatilizing from the liquid droplets landing on the ejection target medium from adhering to a recording head. On the other hand, when the gap between the nozzle orifices and the ejection target medium is wide, the driving of the blowing mechanism is weakened so that the stream of air becomes weak. As a result, the liquid droplets can land on predetermined landing positions and it is possible to suppress the scattering of satellite droplets incidentally produced around the discharged liquid droplets in the form of mist in the device due to the stream of air blown from the blowing mechanism. Therefore, it is possible to suppress the occurrence of a device failure such as an electrical short-circuit of an electronic part such as a circuit board which is attributable to adherence of volatilizing liquid droplets and scattering mist and suppress the deterioration of an adhesive used in the liquid ejecting head regardless of the gap between the nozzle orifices and the ejection target medium while maintaining the discharge stability of the liquid droplets.

In the liquid ejecting apparatus, it is preferable that the gap between the nozzle orifices and the ejection target medium is controlled in at least two steps and that the blowing mechanism is more weakly driven as the gap between the nozzle orifices and the ejection target medium becomes wider.

According to the structure, the gap between the nozzle orifices and the ejection target medium is controlled in at least two steps and the driving mechanism is more weakly driven as the gap between the nozzle orifices and the ejection target medium becomes wider. Accordingly, it is possible to suppress the adherence of the air volatilizing from the liquid droplets and the scattering mist to the liquid ejecting head while maintaining the discharge stability of the liquid droplets.

In the liquid ejecting apparatus, it is preferable that when the gap between the nozzle orifices and the ejection target medium is a predetermined size or larger, the driving of the blowing mechanism is stopped.

According to the structure, when the gap between the nozzle orifices and the ejection target medium is a predetermined size or larger, the driving of the blowing mechanism is stopped. Accordingly, it is possible to prevent the scattering of mist which accompanies the blowing of the stream of air from the blowing mechanism.

In the liquid ejecting apparatus, it is preferable that the blowing mechanism includes a cover surrounding the blowing mechanism and having an opening on the ejection target medium side, in which when the gap between the nozzle orifices and the ejection target medium is a predetermined size or larger, the opening of the cover is closed by a cover member.

According to the structure, the blowing mechanism has a cover surrounding the blowing mechanism and having an opening on the ejection target medium side, in which when the gap between the nozzle orifices and the ejection target medium is a predetermined size or larger, the opening of the cover is closed by a cover member. Accordingly, it is possible to suppress the adherence of the scattering mist to the inside of the blowing mechanism.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
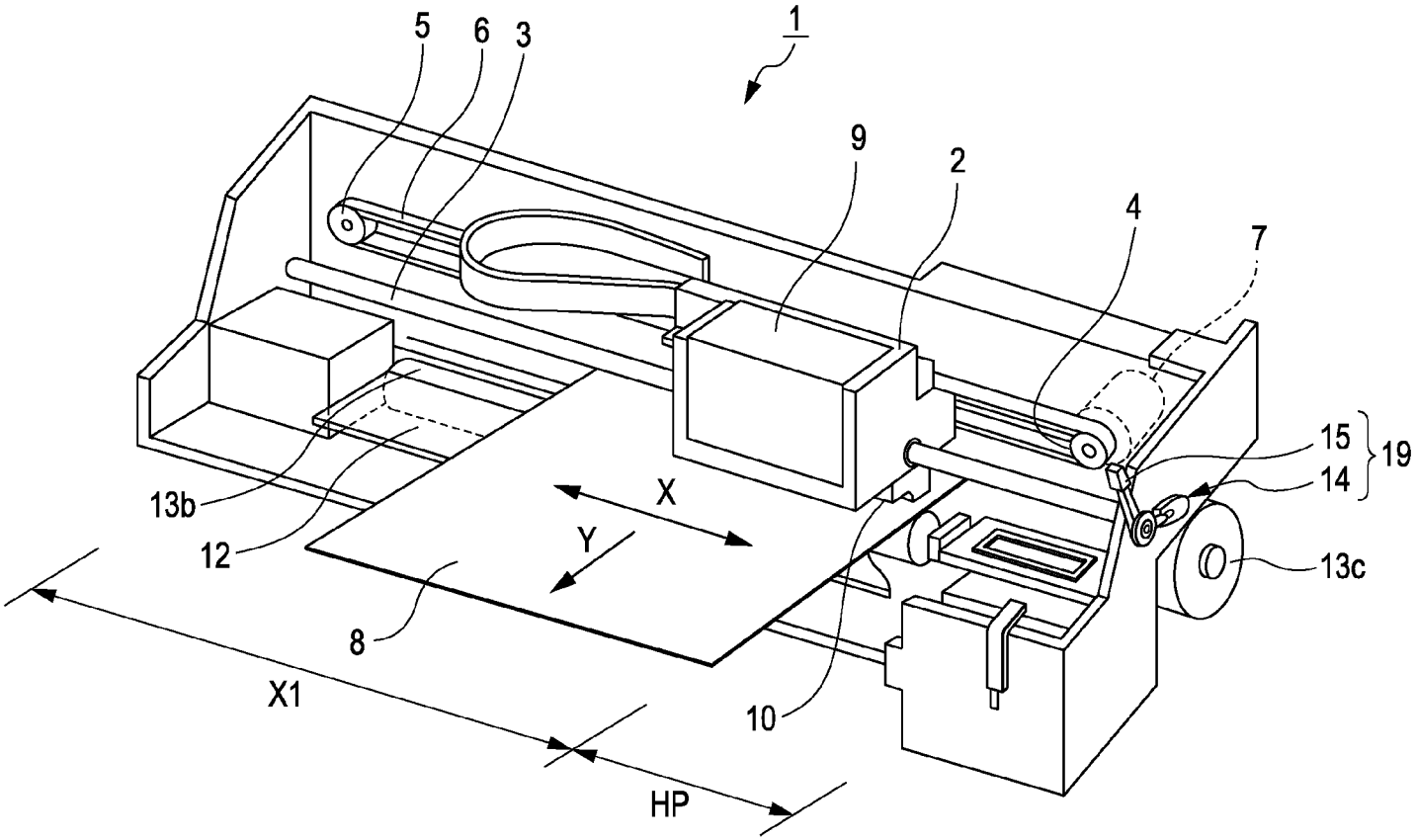
FIG. 1 is a perspective view illustrating a printer.

Hereinafter embodiments of the invention will be described with reference to the accompanying drawings. FIG. 1 is a perspective view illustrating an ink jet printer which is a representative ink jet type recording device. First, the entire structure will be described with reference to FIG. 1.

An ink jet printer 1 is structured such that a carriage 2 is movably attached to a guide shaft 3 and the carriage 2 is connected to a timing belt 6 stretched across a gap between a drive pulley 4 and a freely rotating pulley 5. The drive pulley 4 is united with a rotary shaft of a pulse motor 7 and the carriage 2 is moved in a widthwise direction (main scanning direction, denoted by a reference X in the figure) of recording paper (an ejection target medium) 8 when the pulse motor 7 is driven. An ink cartridge 9 is detachably attached to an upper portion of the carriage 2, and a pair of recording heads 10 is attached to the surface (lower surface) of the carriage 2 which faces the recording paper 8. A platen 12 is placed under the guide shaft 3 in parallel with the guide shaft 3. Ink in the ink cartridge 9 may be aqueous ink or a solvent type such as an organic solvent-based ink.

Figure 2:
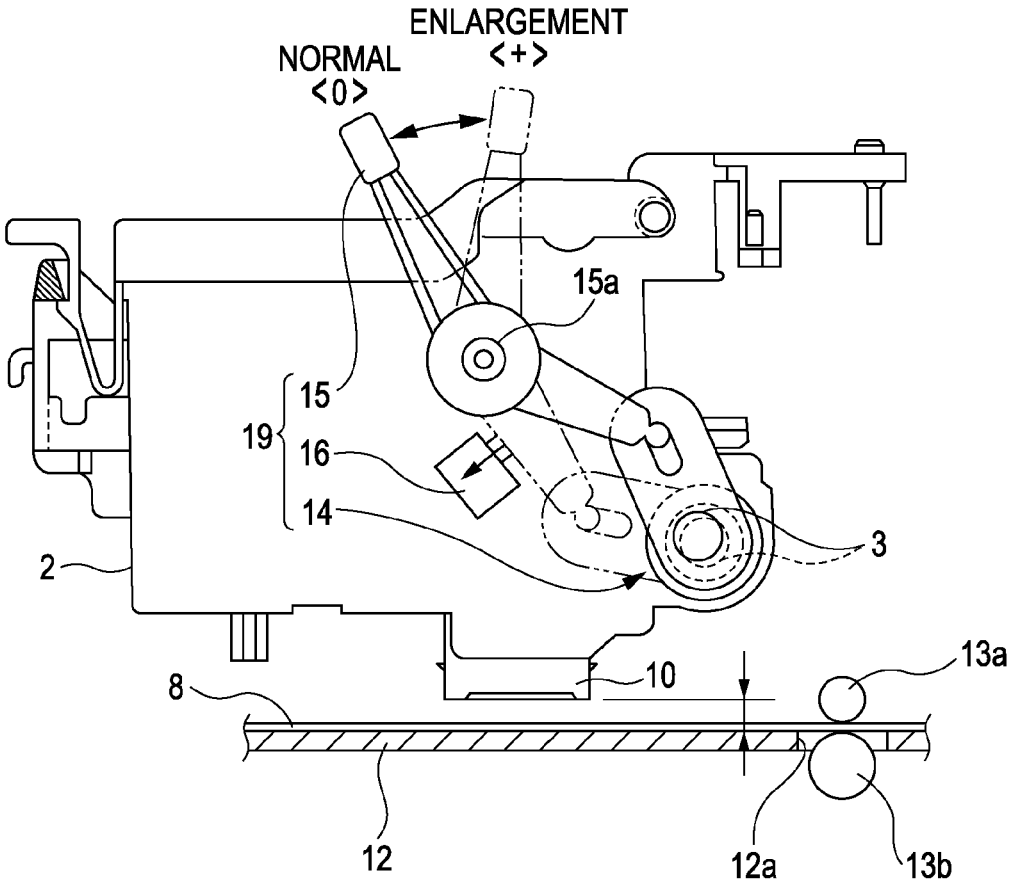
FIG. 2 is a side view illustrating a gap control mechanism in an enlarged manner.

The platen 12 is formed of a plate-shaped member which guides the recording paper 8. Accordingly, on the upstream side of the platen 12 in a paper sending direction (corresponding to a sub-scanning direction, denoted by a reference Y in the figure), as shown in FIG. 2, a pair of paper sending rollers 13*a* and 13*b* is placed so as to face roller window portions 12*a*. The paper sending rollers 13*a* and 13*b* are rotated due to the operation of the paper sending motor 13*c* and transport the recording paper 8 in the paper sending direction.

An end portion of the guide shaft 3 is provided with a gap control mechanism 19 (corresponding to a gap control portion of the invention). The gap control mechanism 19 of the embodiment is a mechanism for adjusting a gap (corresponding to a gap of the invention and called a platen gap) from the nozzle orifices 33 (see FIG. 4) of the recording head 10 to the platen 12 by moving the recording head 10 in a vertical direction. As shown in FIG. 2, the gap control mechanism 19 is composed of an eccentric cam 14 which supports the guide shaft 3 in an eccentric state in which the guide shaft 3 is deviated from a rotary center, an adjusting lever 15 connected to the eccentric cam 14, a platen gap detecting sensor 16 which is disposed at a position corresponding to a moving range of the adjusting lever 15 and whose operation state changes depending on the position of the adjusting lever 15, and a controller 46 (see FIG. 4).

In the gap control mechanism 19, the eccentric cam 14 is rotated by pivoting the adjusting lever 15 on a spindle 15*a*, and the guide shaft 3 moves in the vertical direction. Therefore, the carriage 2 moves in the vertical direction along with the vertical movement of the guide shaft 3 and the platen gap is changed. For example, as shown by a solid line in FIG. 2, if the adjusting lever 15 is moved to the <0> side, the guide shaft 3 moves downward (see a dashed line). This state is a normal state in which the carriage 2 and the recording head 10 (the nozzle orifices 33) stay close to the platen 12. On the other hand, if the adjusting lever 15 is moved to the <+> side, the guide shaft 3 moves upward (see an imaginary dashed two-dotted line in FIG. 2). In this state, the recording head 10 (the nozzle orifices 33) is moved further apart from the platen 12 as compared to the normal state and the platen gap is increased. In the description below, the state in which the platen gap is increased is called "large gap" state.

For relatively thin recording paper such as plain paper, the adjusting lever 15 is moved to the <0> side (thin paper side) so that the platen gap is set to the normal state. On the other hand, for relatively thick recording paper 8 such as board paper, the adjusting lever 15 is moved to the <+> side (thick paper side) so that the guide shaft 3 is raised and the platen gap is set to the large gap state. The platen gap is adjusted in the above-described manner so that the gap from the nozzle orifices 33 to the recording surface of the recording paper 8 is adjusted to be in a predetermined range which is adequate for recording.

According to the embodiment, the platen gap detecting sensor 16 is composed of a so-called micro switch. Therefore, when the adjusting lever 15 is moved to the <+> side, a switch portion of the platen gap detecting sensor 16 comes into contact with and is pushed by the adjusting lever 15 so that the switch portion turns on. If the adjusting lever 15 is moved toward the <0> side from the position of the <+> side, the contact state between the switch portion and the adjusting lever 15 is released and the switch portion turns off. Accordingly, it is possible to detect whether the gap from the nozzle orifices 33 to the recording paper 8 is in the normal state (small gap state) or in the large gap state by monitoring a detecting signal from the platen gap detecting sensor 16. In the embodiment, the detecting signal from the platen gap detecting sensor 16 is input to a controller 46, allowing the controller 46 to recognize the platen gap.

Figure 3:
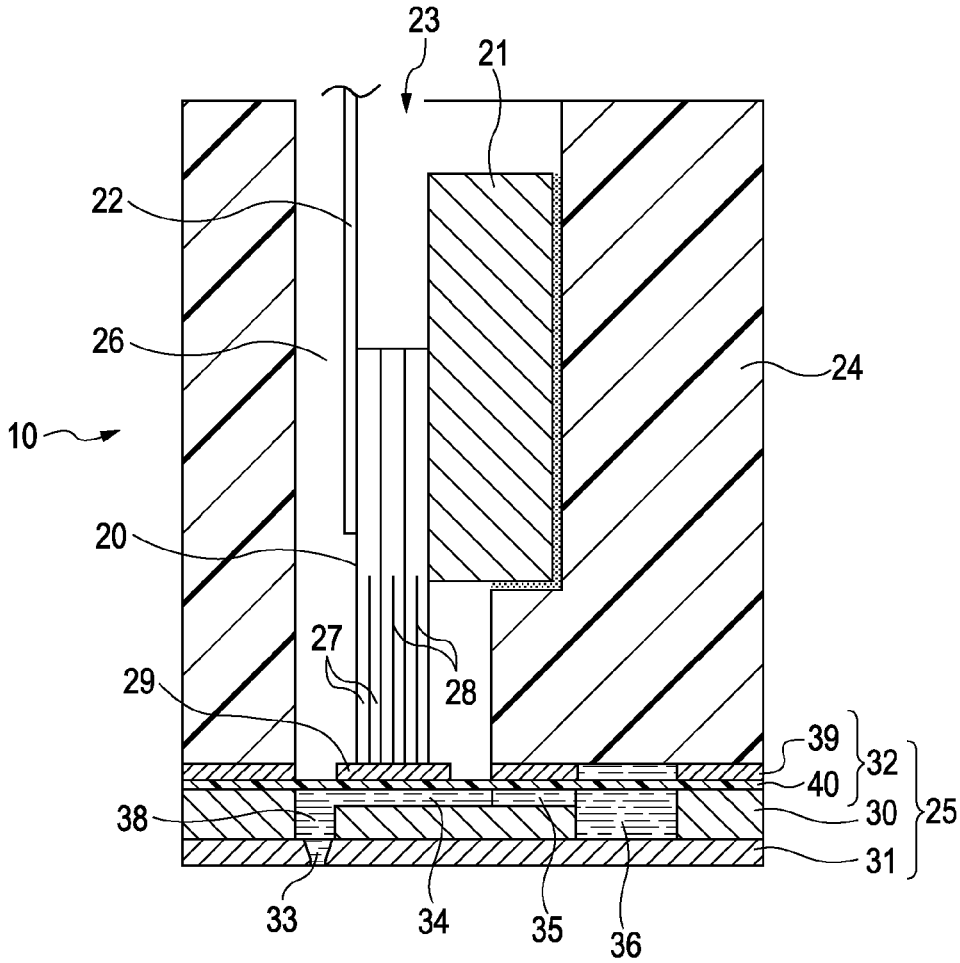
FIG. 3 is a sectional view for explaining an inside structure of a recording head.

Next, the structure of the recording head 10 will be explained. As shown in FIG. 3, the exemplary recording head 10 includes a resonator unit 23 in which a plurality of piezoelectric resonators 20, a fixed plate 21, and flexible cable 22 are combined, a case 24 which can contain the resonator unit 23 therein, and a channel unit 25 united with a front end surface of the case 24.

The case 24 is a synthetic resin-based block-shaped member having a containing space 26 whose front and back ends are open. The resonator unit 23 is contained in the containing space 26 in a fixed manner. The resonator unit 23 has a posture in which a pectinate front end (front end surface) of the piezoelectric resonator 20 faces a front end side opening and the fixed plate 21 is bonded to a surface of a wall of the containing space 26.

The piezoelectric resonator 20 is a kind of electromechanical transducing element. The piezoelectric resonator 20 has a pectinate shape composed of needle shapes. A base portion of the piezoelectric resonator 20 is united with the fixed plate 21. The front end surface of each of the piezoelectric resonators 20 abuts on and is fixed to an island portion 29 of the channel unit 25. The flexible cable 22 is electrically connected to each of the piezoelectric resonators 20 at the side surface of the base portion of the piezoelectric resonators on the opposite side from the fixed plate 21.

The channel unit 25, as shown in FIG. 3, is configured such that the channel-forming substrate 30 which is an interposed substrate, a nozzle plate 31 placed on a surface of one side of the channel-forming substrate 30, and the elastic plate 32 placed on a surface of the opposite side of the channel-forming substrate from the nozzle plate 31 are united with and fixed to one another by an adhesive in a stacked state.

The nozzle plate 31 is a stainless steel-based thin plate in which a plurality of nozzle orifices 33 is formed in rows at a pitch corresponding to a dot formation density.

In the present embodiment, 360 nozzle orifices 33 are formed at a pitch of 360 dpi and nozzle columns are formed by these nozzle orifices 33. The number of nozzle columns is set so as to correspond to the number of kinds (for example, colors) of ink which can be discharged.

The channel-forming substrate 30 is a plate-shaped member in which a plurality of hollow portions which becomes pressure generating chambers 34 is formed so as to correspond to nozzle orifices 33 of the nozzle plate 31 by partitioning a space with barrier ribs and in which hollow portions which become an ink supply inlet 35 and a common ink chamber 36 are also formed. For example, the channel-forming substrate 30 is formed by subjecting a silicon wafer to etching processing. Each of the pressure generating chambers 34 is an oblate cavity. In the pressure generating chamber 34, a nozzle communicating hole 38 which enables the nozzle orifices 33 and the pressure generating chamber 34 to communicate with each other is formed at the farthest position from the common ink chamber 36 by puncturing the plate in the thickness direction.

The elastic plate 32 serves as both a diaphragm portion which seals the open surface on one side of the pressure generating chamber 34 and a compliance portion which seals an open surface on one side of the common ink chamber 36, and has a double structure in which resin film 40 such as polyphenylene sulfide (PPS) is laminated on the stainless steel plate 39. Accordingly, the island portion 29 is formed by etching a portion of the stainless steel plate 39 which serves as the diaphragm portion in the form of a ring.

In the recording head 10 having the above-described structure, with the operation of the piezoelectric resonator 20 such as the piezoelectric resonator 20 being electrically discharged so as to expand in a lengthwise direction (i.e. longitudinal direction), the island portion 29 is pushed toward the nozzle plate 31 side and the resin film 40 constituting the diaphragm portion is deformed so that the pressure generating chamber 34 is contracted. On the other hand, if the piezoelectric resonator 20 is electrically charged and contracts in the lengthwise direction of the piezoelectric resonator, the pressure generating chamber 34 expands due to elasticity of the resin film 40. That is, ink droplets are discharged from the nozzle orifices 33 by controlling the expansion and contraction of the pressure generating chamber 34 so that the ink pressure in the pressure generating chamber 34 is changed.

Figure 4:
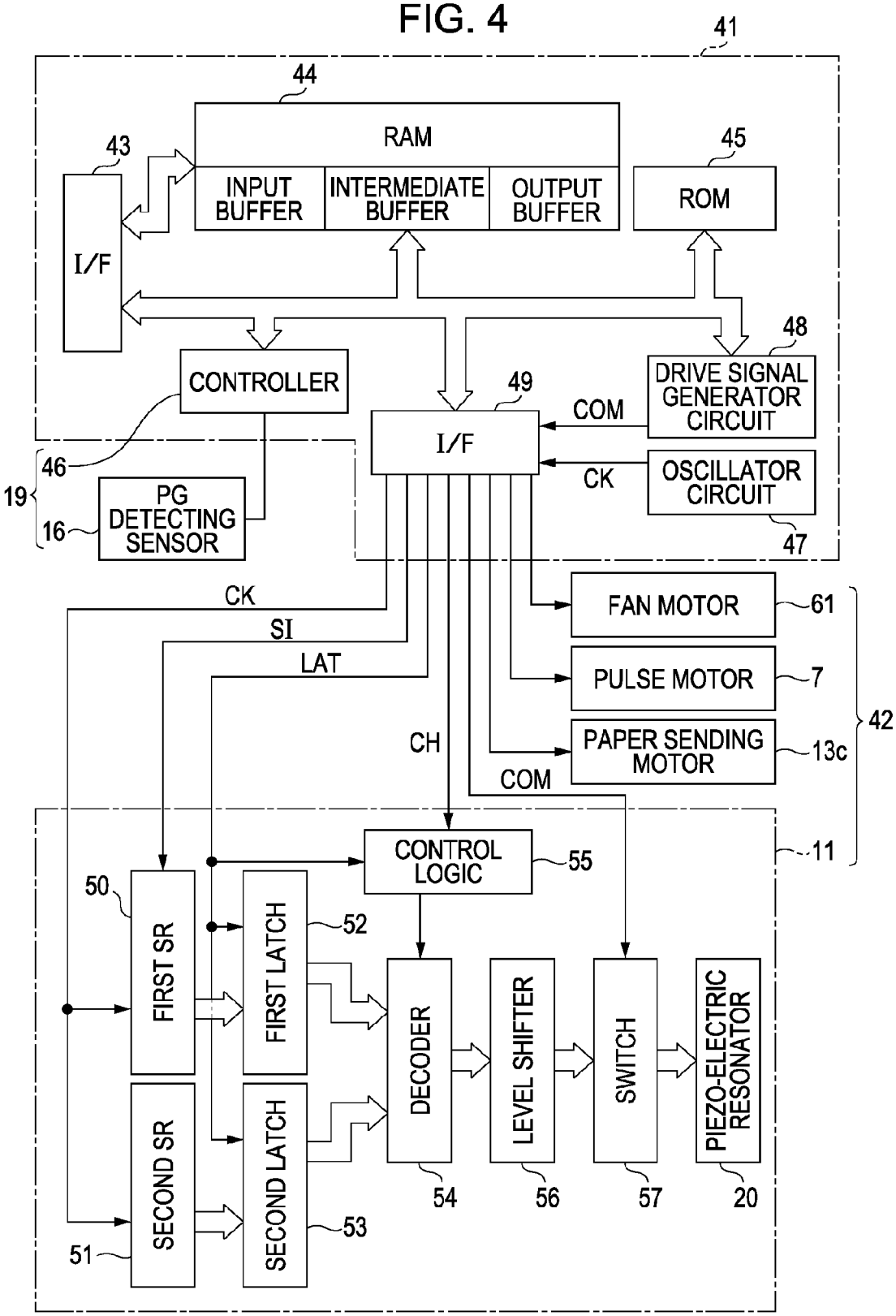
FIG. 4 is a block diagram for explaining an electrical structure of the printer.

Next, the electrical structure of the printer 1 will be described. The exemplary printer 1 includes a printer controller 41 and a print engine 42 as shown in FIG. 4.

The printer controller 41 includes an interface 43 (hereinafter, referred to as external I/F 43) which receives print data and so on from a host computer (not shown), a random access memory (RAM) 44 which stores various kinds of data, a read only memory (ROM) 45 which stores control routines for processing the various kinds of data, a controller 46 being composed of a central processing unit (CPU) or the like, an oscillator circuit 47 which generates a clock signal CK, a drive signal generator circuit 48 which generates a drive signal COM to be supplied to the recording head 10, and an interface 49 (hereinafter, referred to as internal I/F 49) which transmits printing data SI obtained by developing the print data for every dot, the drive signal and so on to the print engine 42.

The external I/F 43 receives, for example, information such as character codes, graphic functions, and image data and print data composed of plural pieces of data from the host computer. A control command (recording mode setting information) for specifying a recording mode sent from the host computer is input via this external I/F 43. On the other hand, a busy signal BUSY and an acknowledge signal ACK are output to the host computer from the external I/F 43. In the case in which the recording mode cannot be used on the basis of the recording mode setting information due to the platen gap setting, an error code for notifying the incompatibility is sent to the host computer via the external I/F 43.

The RAM 44 is used as an input buffer, an intermediate buffer, an output buffer, and a work memory (not shown). The input buffer temporarily stores the print data that the external I/F 43 receives from the host computer. The intermediate buffer stores intermediate code data converted to an intermediate code by the controller 46. In the output buffer, the printing data for every dot (dot pattern data) is developed. The ROM 45 stores various kinds of control routines executed by the controller 46, font data, graphic functions, and various kinds of procedures.

The drive signal generator circuit 48 generates various kinds of drive signals corresponding to the recording modes. It generates, for example, a drive signal containing various kinds of drive pulses corresponding to ink droplets having different volumes or a drive signal containing drive pulses corresponding to ink droplets having the same volume in which the drive pulses sequentially and continuously come after one another.

The controller 46 reads and converts the print data in the input buffer into the intermediate code, and intermediate code data is stored in the intermediate buffer. The controller 46 analyzes the intermediate code data read from the intermediate buffer, and develops the intermediate code data into the printing data with reference to the font data and the graphic function in the ROM 45. The printing data is composed of, for example, 2-bit gradation information.

If the developed printing data is stored in the output buffer and the printing data corresponding to one line of the recording head 10 is obtained, the printing data SI of one line is serially transmitted to the recording head 10 via the internal I/F 49. When the printing data of one line is sent from the output buffer, the contents of the intermediate buffer are erased and then conversion is performed for the next intermediate code.

The controller 46 supplies a latch signal LAT and a channel signal CH to the recording head 10 via the internal I/F 49. The latch signal and the channel signal define supply-starting timings of the pulse signals constituting the drive signal COM. The controller 46 sets an edgeless printing mode or a normal printing mode (edge printing mode) on the basis of edgeless printing mode setting information from the host computer.

The print engine 42 includes an electrical drive system 11 of the recording head 10, a pulse motor 7 which makes the carriage 2 run, a paper sending motor 13*c*, and a fan motor 61 of the blowing mechanism 60 which will be described later.

The electrical drive system 11 of the recording head 10 includes a shift register circuit composed of a first shift resistor 50 and a second shift resistor 51, a latch circuit composed of a first latch circuit 52 and a second latch circuit 53, a decoder 54, a control logic 55, a level shifter 56, a switch circuit 57, and a piezoelectric resonator 20. There may be a plural sets of the shift resistors 50 and 51, latch circuits 52 and 53, decoder 54, level shifter 56, switch circuit 57, and the piezoelectric resonator 20, in which the number of sets is set so as to correspond to nozzle orifices 33 of the recording head 10.

The recording head 10 discharges ink droplets on the basis of the printing data (gradation information) from the printer controller 41. That is, the printing data SI from the printer controller 41 is serially transmitted to the first shift register 50 and the second shift register 51 from the internal I/F 49 in synchronization with the clock signal CK from the oscillator circuit 47. The printing data from the printer controller 41 is 2-bit data and represents 4 gradation levels composed of no recording, small dot, middle dot, and large dot.

Figure 5:
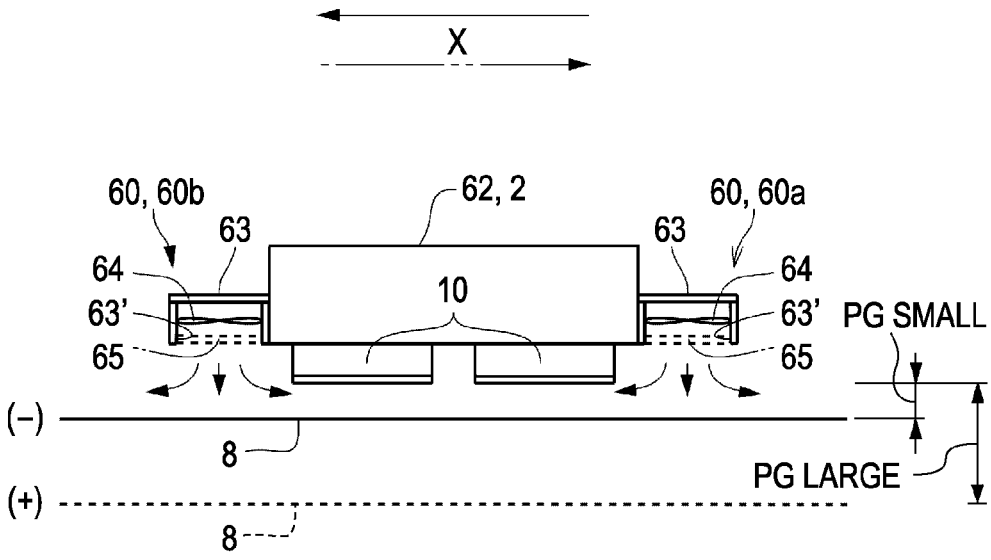
FIG. 5 is a side view illustrating a blowing mechanism.
Figure 6:
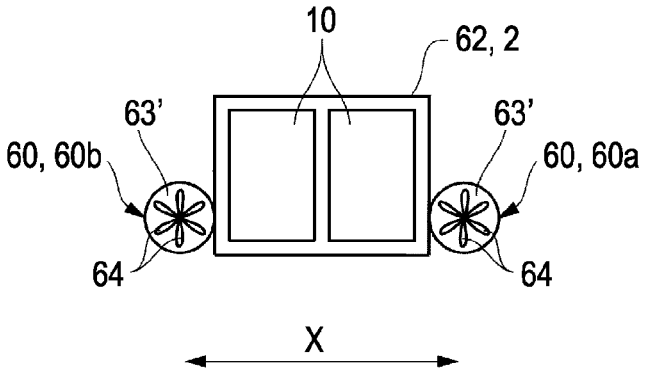
FIG. 6 is a plan view illustrating the blowing mechanism.

Next, the blowing mechanism 60 disposed on the recording head 10 side will be described. FIG. 5 is a side view illustrating the blowing mechanism 60, and FIG. 6 is a plan view illustrating the blowing mechanism 60. The above-described recording head 10 is fixed to a foundation ring 62 of the carriage 2 in the state in which the channel unit 25 is exposed to the air as shown in FIGS. 5 and 6, blowing mechanisms 60 in a pair are disposed on both side surfaces of the foundation ring 62 in the main scanning direction X. Each of the blowing mechanisms 60 includes a cover 63 having an opening 63' and a fan 64 contained in the cover 63. The cover 63 is a box shape or a barrel shape and is placed so as to surround the fan 64 in a state in which the opening 63' faces the recording paper 8. If the drive signal from the controller 46 is supplied to the fan motor 61, the fan 64 is rotated about an axis center and blows air introduced through an inlet (not shown) which is an opening provided in the upper surface of the cover 63 toward the recording paper 8 from the opening 63'.

The driving of the blowing mechanism 60 is controlled by the controller 46 depending on the platen gap (gap PG) detected by the platen gap detecting sensor 16. That is, the blowing mechanism 60 is controlled by the controller 46 such that the number of rotations is increased (the driving is strong) in the normal state in which the platen gap PG is narrow as shown by a solid line in FIG. 6 and is decreased (the driving is weak) in the large gap state in which the platen gap PG is wide as shown by a dashed line in FIG. 6.

Accordingly, the blowing mechanism 60 of the invention is controlled such that the driving of the blowing mechanism 60 is stopped when the platen gap PG is a predetermined size or larger. That is, the blowing mechanism 60 is controlled such that the driving of the blowing mechanism 60 becomes weaker than the normal state as the platen gap PG becomes wider and the driving of the blowing mechanism 60 is stopped in the case in which the platen gap PG is out of the predetermined range. The platen gap PG between the recording paper 8 and the nozzle orifices 33 in the gap control mechanism 19 may be controlled in three steps or more. For example, in the case in which the platen gap can be adjusted to a middle gap state in between the normal state and the large gap state, in the blowing mechanism 60 controlled in three steps, the number of rotations is increased in the normal state, the number of rotations in the middle gap state is decreased to be smaller than the normal state, and the rotation is stopped in the large gap state (the gap is a predetermined size or larger).

The blowing mechanism 60 is controlled such that when the carriage 2 moves forward in the scanning direction X on the printing area (denoted by a reference X1 in FIG. 1) of the recording paper 8 from a home position (denoted by a reference HP in FIG. 1) which is a non-printing area as shown by a solid line in FIG. 5, the blowing mechanism 60 (hereinafter, this blowing mechanism is denoted by a reference 60*a*) on the home position HP side is driven but the driving of the blowing mechanism 60 (hereinafter, this blowing mechanism is denoted by a reference 60*b*) on the opposite side is stopped, while, when the carriage 2 moves backward in the scanning direction X from the printing area X1 to the home position HP as shown by a dashed two-dotted line in FIG. 5, the blowing mechanism 60*b* is driven but the driving of the opposite side blowing mechanism 60*a* is stopped. That is, the blowing mechanisms 60*a* and 60*b* are controlled such that the blowing mechanism on the back side in the scanning direction X is driven but the driving of the blowing mechanism on the front side is stopped when the carriage 2 moves forward on the printing area X1.

Each of the covers 63 of the blowing mechanisms 60*a* and 60*b* is provided with a cover member 65 (indicated by a dashed line in FIG. 5) which can open and close the opening 63' on the basis of the drive signal from the controller 46. The cover member 65 is structured to be capable of being slid by a solenoid drive type sliding mechanism (not shown). For example, the cover member 65 is controlled by the controller 46 such that in the case in which the platen gap PG is in the normal state, the cover member 65 falls into a closed state and the opening 63' is closed (covered) by the cover member 65 while in the case of the large gap state, the cover member 65 falls into an open state and the opening 63' is unclosed. With such a control, it is possible to suppress the occurrence of an event such as one in which the satellite droplets produced around the ejected ink droplets turn into mist, scatter, and adhere to the fan 64 and the axis center of the fan 64. Further, it is possible to prevent the driving of the blowing mechanisms 60*a* and 60*b* from becoming weaker.

Next, the driving of the blowing mechanism 60 having the above structure will be described. In the case in which the printing is performed when the platen gap PG is in the normal state, the cover member 65 enters the closed state in which the cover members 65 of the covers 63 of the blowing mechanisms 60*a* and 60*b* cover the openings 63' and the blowing mechanisms 60*a* and 60*b* remain stopped at the home position HP. If the recording head 10 attached to the carriage 2 moves forward in the scanning direction X along the guide shaft 3 and arrives at the printing area X1, the cover members 65 of the covers 63 slide and change to the open state. Therefore, the openings 63' are uncovered and the blowing mechanism 60*a* out of the blowing mechanisms 60*a* and 60*b* is driven to blow a stream of air toward the recording paper 8 in the state in which the driving of the blowing mechanism 60*b* is stopped. In such a state, if the recording head 10 moves on the printing area X1 while discharging ink droplets from the nozzle orifices 33 and arrives at the end of the opposite side from the home position HP, the driving of the blowing mechanism 60*a* out of the blowing mechanisms 60*a* and 60*b* is stopped and then the recording head 10 moves backward in the scanning direction X toward the home position HP while driving the blowing mechanism 60*b*. Therefore, if the recording head 10 reaches the home position HP and finishes the printing after repeatedly performing the forward and backward movements, the blowing mechanisms 60*a* and 60*b* enter the closed state in which the cover members 65 of the covers 63 cover the openings 63' and the blowing mechanisms 60*a* and 60*b* are stopped.

As described above, by controlling the driving of the blowing mechanisms 60*a* and 60*b* in the normal state of the platen gap PG, it is possible to suppress the occurrence of an event such as one in which the satellite droplets produced around the ejected ink droplets turn into mist, scatter in the device, and stick to the surface of the nozzle plate 31. Further, it is possible to suppress the occurrence of discharge failures caused by the peripheral areas of the nozzle orifices 33 being polluted by the mist of ink droplets. In the case of using, for example, ink solvent based on a solvent as the ejected liquid, the air volatilizing from the ink droplets landing on the recording paper 8 is expelled from a space between the recording paper 8 and the recording head 10 by the stream of air from the blowing mechanisms 60*a* and 60*b*. Therefore, it is possible to suppress the deterioration of the adhesive used to bond the channel unit 25 of the recording head 10.

In the case of performing the printing when the platen gap PG is in the large gap state, the printing is performed through the same operation as in the normal state in the state in which the blowing mechanisms 60*a* and 60*b* are more weakly driven than the normal state. However, in the case of performing the printing when the platen gap PG is a predetermined size or lager, the printing is performed through the same operation as in the normal state or the large gap state, in the state in which the cover members 65 of the covers 63 of the blowing mechanisms 60*a* and 60*b* maintain the closed state of the openings 63' and the driving of the blowing mechanism 60*a* and 60*b* is stopped. Doing so, it is possible to prevent the so-called flight curve which means that the ink droplets discharged from the nozzle orifices 33 fly along a curved flight path before landing on the recording paper 8 and causing a landing position error due to the stream of air from the blowing mechanism 60. Therefore, the ink droplets can land on their predetermined positions and it is possible to suppress the mist of the ink droplets and the steam of the landing ink droplets from adhering to the recording head 10. As described above, the printer 1 of the invention can suppress the occurrence of a failure such as an electrical short-circuit of an electronic part such as a circuit board which is attributable to the adherence of the scattering mist and the ink droplets volatilizing from the ink landing on the recording paper 8 while maintaining the discharge stability of the ink droplets regardless of the platen gap PG between the nozzle orifices 33 and the recording paper 8 and can also suppress the deterioration of the adhesive used in the recording head 10.

Although the ink jet recording head has been described above, for example, the invention can be also applied to a liquid discharging head which discharges liquid other than ink. For example, the invention may be applied to a display manufacturing device for manufacturing a color filter of a liquid crystal display or the like, an electrode manufacturing device for forming an electrode of an organic electro luminescence (EL) display, a field emission display (FED), or the like, and a chip manufacturing device for manufacturing a biochip (biochemical element).

What is claimed is:

1. A liquid ejecting apparatus comprising:

a liquid ejecting head which ejects liquid from a nozzle orifice;

a gap control unit which controls a gap between the nozzle orifices and an ejection target medium;

a blowing mechanism which blows a gas towards the ejection target medium; and wherein driving of the blowing mechanism is controlled depending on the gap between the nozzle orifices and the ejection target medium, and the gap between the nozzle orifices and the ejection target medium is controlled in at least two steps, and wherein the blowing mechanism is more weakly driven as the gap between the nozzle orifices and the ejection target medium becomes wider.

2. The liquid ejecting apparatus according to claim 1, wherein the blowing mechanism is disposed on a carriage which is attached to the liquid ejection head.

3. The liquid ejecting apparatus according to claim 1, wherein when the gap between the nozzle orifices and the ejection target medium is a predetermined size or larger, the driving of the blowing mechanism is stopped.

4. The liquid ejecting apparatus according to claim 1, wherein the blowing mechanism includes a cover which surrounds the blowing mechanism and has an opening on an ejection target medium side, and wherein when the gap between the nozzle orifices and the ejection target medium is a predetermined size or larger, the opening of the cover is closed by a cover member.

5. A liquid ejecting apparatus comprising:

a liquid ejecting head which ejects liquid from nozzle orifices;

a gap control unit which controls a gap between the nozzle orifices and a supporting member which supports an ejection target medium; and a blowing mechanism which blows a gas toward the ejection target medium, wherein blow of the blowing mechanism is controlled depending on the gap between the nozzle orifices and the supporting member, and the gap between the nozzle orifices and the supporting member is controlled in at least two steps, and the blowing mechanism is more weakly driven as the gap between the nozzle orifices and the supporting member becomes wider.

6. The liquid ejecting apparatus according to claim 5, wherein when the gap between the nozzle orifices and the supporting member is a predetermined size or larger, the blow of the blowing mechanism is stopped.

* * * * *